United States Patent [19]

Chia et al.

[11] Patent Number: 4,733,717

[45] Date of Patent: Mar. 29, 1988

[54] METHOD OF AND APPARATUS FOR CASTING AND HOT-FORMING COPPER METAL AND THE COPPER PRODUCT FORMED THEREBY

[75] Inventors: E. Henry Chia; Robert H. Ogletree; Frank M. Powers, all of Carrollton, Ga.

[73] Assignee: Southwire Company, Carrollton, Ga.

[21] Appl. No.: 831,865

[22] Filed: Feb. 24, 1986

[51] Int. Cl.[4] ..... B22D 11/06; B21B 1/46; B21B 13/22

[52] U.S. Cl. ..... 164/476; 164/482; 164/485; 164/417; 148/2; 29/527.7

[58] Field of Search ..... 164/476, 482, 485, 417; 148/2; 29/527.7

[56] References Cited

U.S. PATENT DOCUMENTS

| | | | |
|---|---|---|---|
| 3,315,349 | 4/1967 | Cofer | 164/476 |
| 3,349,471 | 10/1967 | Bell et al. | 164/476 |
| 3,672,430 | 6/1972 | Cofer | 164/476 |
| 4,232,727 | 11/1980 | Bower et al. | 164/476 |
| 4,352,697 | 10/1982 | Adams et al. | 164/476 |
| 4,354,880 | 10/1982 | Adams et al. | 164/476 |
| 4,412,871 | 1/1983 | Parikh et al. | 148/2 |
| 4,584,029 | 4/1986 | Chia | 164/476 |

*Primary Examiner*—Nicholas P. Godici
*Assistant Examiner*—Samuel M. Heinrich
*Attorney, Agent, or Firm*—George C. Myers, Jr.; Stanley L. Tate

[57] ABSTRACT

A method of and apparatus for continuously casting a high impurity content molten metal in a casting means and the product formed thereby. The method includes the steps of cooling said metal while in said casting means to a temperature resulting in a sound cast bar, extracting the sound cast bar from said casting machine, advancing the sound cast bar to pre-heating means, heating the sound cast bar to a hot-forming temperature, passing the cast bar at a hot-forming temperature from the pre-heating means to a hot-forming means, and hot-forming the cast bar into a wrought product without the cat bar cracking, even when the cast bar has an impurity content of from about 20 to about 200 ppm.

9 Claims, 1 Drawing Figure

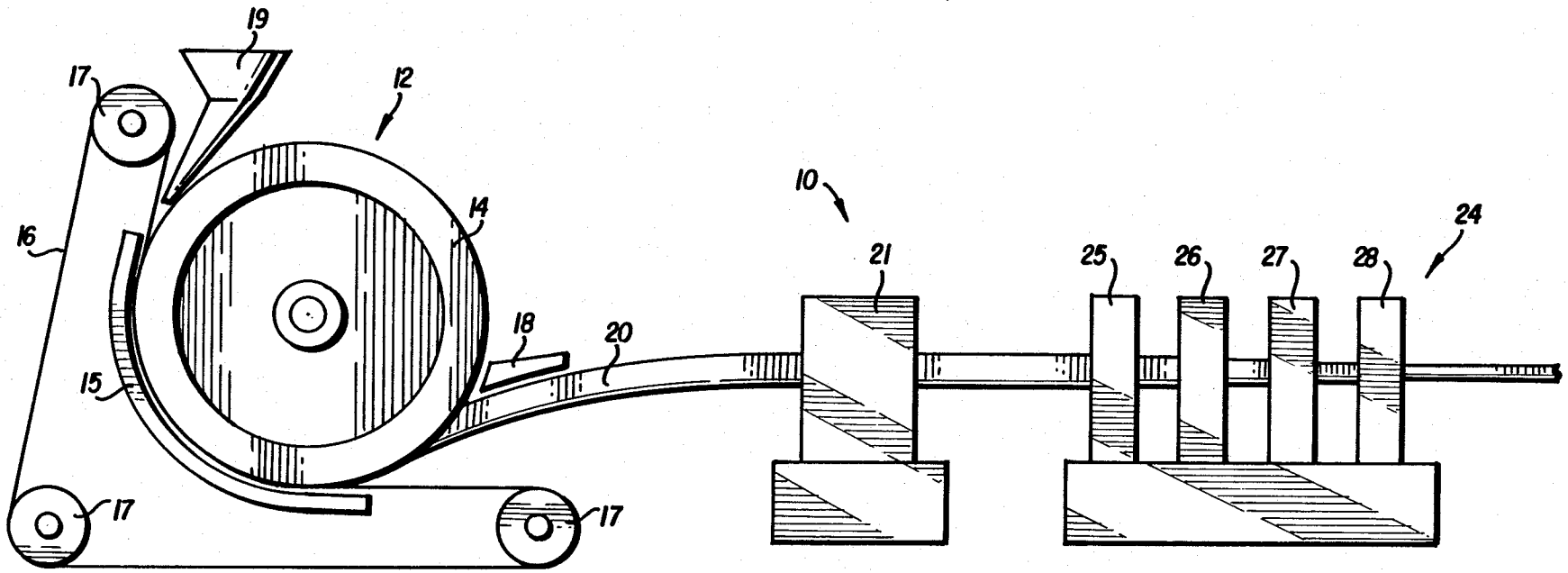
24
28
27
26
25
21
10
20
18
14
12
19
17
17
15
16

METHOD OF AND APPARATUS FOR CASTING AND HOT-FORMING COPPER METAL AND THE COPPER PRODUCT FORMED THEREBY

FIELD OF THE INVENTION

The present invention relates generally to the hot forming of metals, and more particularly to the continuous casting and hot forming of bars of certain impure metals prone to crack during hot-rolling. Even more particularly, the present invention relates to a method of and an apparatus for improving the quality of a cast bar in a continuous casting process by cooling the bar while in the groove of the casting wheel to a temperature which results in a sound casting, removing the sound cast bar from the groove and advancing the sound casting to heating means, heating the sound cast bar to a hot-forming temperature, and hot-forming the bar in order to prevent cracking. The present invention also relates to the product of the method.

It is well known that many metals, such as copper, may be continously cast, either in stationary vertical molds or in a rotating casting wheel, to obtain a cast bar which is then immediately hot formed, by passing the cast bar exiting the mold to and through the roll stands of a rolling mill while the cast bar is still at a hot-forming temperature. It is also well known that the structure of the metal bar is such that cracking of the cast bar during hot forming may be a problem if the cast bar is required to be directly hot formed into a semi-finished product, such as redraw rod, during which the initially large cross-sectional area of the cast bar is substantially reduced by a plurality of deformations along different axes to provide a much smaller cross-sectional area in the product.

While this problem could be avoided by casting a cast bar having an initially small cross-sectional area which need not be substantially reduced to provide the desired cross-sectional area of the final product, this approach is not commercially practical since high casting outputs, and therefore low costs, can be readily achieved only with cast bars having large cross-sectional areas which are rapidly reduced to the smaller cross-sectional areas of the products, such as 5/16" diameter rod for drawing into wire, by a minimum number of severe deformations. Thus, the problem of a cast bar cracking during hot forming must be solved within the commercial context of cast bars having initially large cross-sectional areas which are then hot formed into products having small cross-sectional areas by a series of reductions which often are substantial enough to cause cracking of the cast bar under certain conditions.

DESCRIPTION OF THE PRIOR ART

This problem has been overcome in the prior art for relatively pure electrolytically-refined tough pitch copper having low impurity levels such as 3–10 ppm lead, 1 ppm bismuth, and 1 ppm antimony. For example, U.S. Pat. Nos. 3,317,994 and 3,672,430 disclose that this cracking problem can be overcome by conditioning such relatively pure copper cast bar by initial large reductions of the cross-sectional areas in the initial roll stands sufficient to substantially destroy the as-cast structure of the cast bar. The additional reductions along different axes of deformation, which would cause cracking of the cast bar, may then safely be performed. This conditioning of the cast bar not only prevents cracking of the cast bar during hot forming but also has the advantage of accomplishing a large reduction in the cross-sectional area of the cast bar while its hot-forming temperature is such as to minimize the power required for the reduction.

The prior art has not, however, provided a solution to the cracking problem described above for relatively impure metals, such as relatively impure electrolytic tough pitch copper and fire-refined copper, which contain relatively high percentages of impurities. This is because the large amount of impurities in the grain boundaries cause the cast bar to crack when an attempt is made to substantially destroy the structure with the same large initial reduction of the cross-sectional area of the cast bar that is known to be effective with low impurity metals. Moreover, the greater the percentage of impurities in the cast bar, the more likely it is that cracks will occur during hot forming.

Thus, although there is no requirement for high-purity electrolytically-refined copper (except for specialized uses such as magnet wire), it has heretofore been necessary to use such highly refined copper in order to be able to use and obtain the many advantages of tandem continuous casting and hot-forming apparatus. As a result, a substantial refining cost is added to the price of many final copper products even though high purity is not required to meet conductivity or other specifications. For example, fire-refined copper wire having a moderately high percentage of impurities can meet the IACS conductivity standard for household electrical wiring and can be produced most economically if the rod to be drawn into such wire can be produced using known continuous casting and hot-forming apparatus.

Additionally, the cracking problem in the prior art is discussed in the patents referred to above, as well as in U.S. Pat. Nos. 3,315,349; 3,349,471; 3,716,423; 4,129,170 and 4,352,297. The cooling of metal in a wheel-and-belt type casting groove is illutrated and discussed in U.S. Pat. Nos. 3,279,000; 3,319,700; 3,321,007; 3,329,197; 3,333,624; 3,333,629; 3,596,702; 3,766,967 and 4,122,889. A means for heating cast aluminum bar before rolling is shown by Canadian Pat. No. 1,100,391.

SUMMARY OF THE INVENTION

The present invention solves the above-described cracking problem of the prior art by providing a method of continuously casting and hot forming both low and high impurity copper metal without substantial cracking of the cast bar occurring during the hot rolling process. Generally described, the invention provides, in a process for continuously casting molten copper to obtain a cast bar with a relatively large cross-sectional area, and hot forming the cast bar at a hot-forming temperature into a product having a relatively small cross-sectional area by a substantial reduction of the cross-sectional area of the cast bar which would be such that the structure of the cast bar would be expected to cause the cast bar to crack, the additional steps of uniformly cooling the bar while in the casting groove to a temperatue resulting in a sound cast bar, removing the sound cast bar from the groove, advancing the sound cast bar to heating means, and heating the sound cast bar to a hot-forming temperature immediately prior to hot-forming of the bar.

For example, the present invention allows a copper cast bar having a cross-sectional area of 5 square inches, or more, and containing as much as 20–200 ppm of impurities such as lead, bismuth, iron and antimony, to be continuously hot-formed into wrought copper rod having a cross-sectional area of ½ square inch, or less, without cracking.

Furthermore, the invention has wide general utility since it can also be used with certain other relatively impure metals as an alternative to the solution to the problem of cracking described in U.S. Pat. Nos. 3,317,994, and 3,672,430.

Thus, it is an object of the present invention to provide an improved method of continuously casting molten copper to obtain a cast bar and continuously hot forming the cast bar into a product having a cross-sectional area substantially less than that of the cast bar without cracking of the cast bar occurring during hot forming.

It is a further object of the present invention to provide a method of continuously casting and hot-forming copper metal containing a relatively high percentage of impurities without using specially shaped reduction rolls in the hot-rolling mill or other complex rolling procedures.

It is a further object of the present invention to provide a method whereby a cast bar may be efficiently hot-formed using fewer roll stands.

It is a further object of the present invention to provide a method for continuously casting and hot-forming fire-refined copper having in excess of 20 ppm impurities.

Further objects, features and advantages of the present invention will become apparent upon reading the following specification when taken in conjunction with the accompanying drawing.

BRIEF DESCRIPTION OF THE DRAWING

FIG. 1 is a schematic representation of casting and forming apparatus according to the invention for practicing the method of the invention and for producing the product of the invention.

DESCRIPTION OF A PREFERRED EMBODIMENT

Referring now to the drawing, FIG. 1 schematically depicts an apparatus for practicing the method of the present invention. The continuous casting and hot-forming system 10 includes a casting machine 12 which further includes a casting wheel 14 having a peripheral groove therein, a flexible band 16 carried by a plurality of guide wheels 17 which bias the flexible band 16 against the casting wheel 14 for a portion of the circumference of the casting wheel 14 to cover the peripheral groove and form a mold between the band 16 and the casting wheel 14. As molten metal is poured into the mold through the pouring spout 19, the casting wheel 14 is rotated and the band 16 moves with the casting wheel 14 to form a moving mold. A cooling system 15 of casting machine 12 causes the molten metal to uniformly solidify in the mold and to exit the casting wheel 14 as a sound cast bar 20. The degree of cooling is significantly greater than that practiced in the prior art.

Where the metal is copper, cooling system 15 uniformly reduces the temperature of the casting to a temperature of from about 1200° F. to about 1400° F. As a result, the bar 20 leaving the casting wheel 14 is a sound casting. Weak spots which existed in the prior art bar which was not cooled in the manner of the present invention tended to break open and cause cracking as the bar 20 was guided away from its arcuate path in the wheel 14 and along a more straight path leading to hot-forming means by extractor 18. By cooling the bar 20 in the present manner, the bar 20 guided away from the wheel 14 by extractor 18 has minimum superheat and, as a result, has a low solubility of hydrogen ($H_2$) in the copper matrix. In addition, the cooling causes a high nucleation rate which produces a fine equiaxed grain structure, and reduces microporosity.

From the casting machine 12, the cast bar 20 passes through a heating means 21. Heating means 21 functions as a pre-heater for raising the bar 20 temperature from the sound casting temperature to a hot-forming temperature of from about 1700° F. to about 1750° F. Immediately after pre-heating, the bar 20 is passed through a conventional rolling mill 24, which includes roll stands 25, 26, 27 and 28. The roll stands of the rolling mill 24 provide the primary hot forming of the cast bar by compressing the pre-heated bar sequentially until the bar is reduced to a desired cross-sectional size and shape.

It has been found that such initial hot-forming compression may be in excess of 40% following cooling and pre-heating according to the present invention. The ability to use very high reductions during subsequent hot-forming means that the desired final cross-sectional size and shape may be reached using a rolling mill having fewer roll stands.

The method of the present invention allows continuous casting and rolling of high impurity metals, such as relatively impure electrolytic touch pitch copper or fire-refined copper generally including from 20 to 200 ppm lead, bismuth, iron and antimony without cracking the bar. Furthermore, cracking is prevented throughout the hot-forming temperature range of the metal. In addition, the method of the present invention is effective for processing relatively pure electrolytically-refined copper. This process can be used with remelted copper scrap, tough pitch grade copper, and copper having from about 20 to about 200 ppm impurities. Thus, the same casting and hot-forming apparatus may be used to produce metals of varying purity depending on the standards which must be met for a particular product. It is no longer necessary to add the cost of additional refining to the cost of the final product when a highly pure product is not specifically required.

Copper bar cast by this invention has dendritic arm spacing from about $0.2\times10^{-2}$ inches to about $1.1\times10^{-2}$ inches, while a majority of dendritic arm spacing of the bar is from about $0.3\times10^{2}$ inches to about $0.8\times10^{-2}$ inches, and a preferred majority of dendritic arm spacing of the bar is from about $0.4\times10^{-2}$ inches to about $0.7\times10^{-2}$ inches. It has been found that copper rod produced according to this invention has a grain size of from about $2.0\times10^{-4}$ inches to about $8.8\times10^{-4}$ inches, with a majority of grain size of from about $2.6\times10^{-4}$ inches to about $6.3\times10^{-4}$ inches, and a preferred majority of grain size of from about $2.6\times10^{-4}$ inches to about $5.0\times10^{-4}$ inches.

According to the present invention, there is provided a method for the continuous casting of molten metal to produce a cast bar, in a mold constituted by a rotatable casting wheel having a concave groove along the circumferential surface thereof and a metallic belt running alongside, and contacting, the circumferential surface of the said casting wheel, said method comprising the steps of cooling the bar while in the groove of the casting wheel to a temperature resulting in a sound cast bar, taking the sound cast bar away from the casting wheel, advancing it toward heating means, pre-heating the cast bar to a hot-forming temperature, and hot-forming the pre-heated bar in a rolling mill.

According to a further aspect of the present invention, there is also provided an apparatus for the continuous casting of molten metal comprising a mold constituted by a rotatable casting wheel having a concave groove along the circumferential surface thereof and a metallic belt adapted to contact the circumferential surface of the casting wheel to form a circumferential mold for producing a cast bar, said apparatus comprising means for cooling the bar while in the groove to a temperature at which the bar is sound, means for extracting the sound bar from the wheel, pre-heating means for heating the sound bar to a hot-forming temperature, and rolling apparatus for hot forming the sound, pre-heated cast bar.

While this invention has been described in detail with particular reference to preferred embodiments thereof, it will be understood that variations and modifications can be effected within the spirit and scope of the invention as described hereinbefore and as defined in the appended claims.

What we claim is:

1. In a method of continuously casting and hot-forming copper containing as much as from about 20 ppm to about 200 ppm impurities wherein the copper is cast into a cast copper bar in a mold, extracted from the mold and hot-formed at a hot-forming temperature by a plurality of sequential compressions, the improvement comprising the steps of:

cooling the cast copper bar while in the casting mold to a first temeprature below which the bar is hot-formed whereby the cast copper bar is solidified into a sound casting;

extracting the sound casting from the casting mold;

preheating the sound casting to a second temperature higher than the first temperature and prior to said hot-forming step; and hot-forming the preheated sound casting into a hot-formed copper product with no or substantially no cracking of the bar.

2. The improvement according to claim 1, wherein said first temperature is from about 1200° F. to about 1400° F.

3. The improvement according to claim 1, wherein said second temperature is from about 1700° F. to about 1750° F.

4. The improvement according to claim 1, wherein said copper is fire-refined copper.

5. The improvement according to claim 1, wherein said copper is tough pitch copper.

6. The improvement according to claim 1, wherein said copper is electrolytically-refined copper.

7. The improvement according to claim 1, wherein said copper has at least 100 ppm impurities.

8. The improvement according to claim 1, wherein said impurities are selected from the group comprising lead, bismuth, iron, antimony and mixtures thereof.

9. The method of claim 1 wherein said cast bar has a cross-sectional area of 5 square inches or more.

* * * * *